US007240716B2

(12) United States Patent
Nichols, Jr. et al.

(10) Patent No.: US 7,240,716 B2
(45) **Date of Patent: *Jul. 10, 2007**

(54) SYSTEM FOR COUPLING ROLLER SHADE TUBES

(75) Inventors: Joseph M. Nichols, Jr., Boyertown, PA (US); Mark A. Walker, Whitehall, PA (US)

(73) Assignee: Lutron Electronics Co., Inc., Coopersburg, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/361,900

(22) Filed: Feb. 24, 2006

(65) Prior Publication Data

US 2006/0137833 A1 Jun. 29, 2006

Related U.S. Application Data

(63) Continuation of application No. 10/691,850, filed on Oct. 23, 2003, now Pat. No. 7,051,782.

(51) Int. Cl.
*E06B 9/11* (2006.01)

(52) U.S. Cl. ..... 160/310; 160/120

(58) Field of Classification Search ..... 160/310, 160/120, 124, 241, 311, 66, 122, 312, 323.1, 160/903, 405

See application file for complete search history.

(56) References Cited

U.S. PATENT DOCUMENTS 3,389,738 A 6/1968 Roth
4,231,411 A 11/1980 Hehl et al.
4,615,371 A 10/1986 Clauss
4,657,059 A 4/1987 Clauss
4,836,264 A 6/1989 Machin
4,838,333 A 6/1989 Mottura
5,013,701 A 5/1991 Coosmans et al.
5,016,701 A * 5/1991 Vore ..... 160/241
7,051,782 B2 * 5/2006 Nichols et al. ..... 160/310

FOREIGN PATENT DOCUMENTS

DE 35 00 611 A1 7/1986
DE 93 18 455 U1 1/1994
DE 195 46 203 C1 3/1997
EP 0 301 666 2/1989

* cited by examiner

*Primary Examiner*—David Purol
(74) *Attorney, Agent, or Firm*—Drinker, Biddle & Reath LLP

(57) ABSTRACT

A coupling assembly for a multiple-tube roller shade includes a support assembly for rotatably supporting and connecting adjacently located tube-end portions and a clutch mechanism providing relative rotation therebetween. The support assembly includes a tube-end fitting and a torque-transferring drive transfer member contacting the tube. The clutch mechanism includes first and second clutch members respectively engaged and separated in closed and opened positions. A pull bar is translatable within one of the shafts and is moved by a draw pin received in aligned openings of the second clutch member, the shaft and the pull bar. The shaft openings are elongated for movement of the second clutch member between the closed and opened positions. An adjustment member threadedly engages the tube-end fitting for vertical adjustment of the fitting with respect to a support panel. The tube-end fitting is secured to a bracket having elongated openings for horizontal adjustment.

28 Claims, 13 Drawing Sheets

SYSTEM FOR COUPLING ROLLER SHADE TUBES

CROSS-REFERENCE TO RELATED APPLICATION

This is a continuation application of application Ser. No. 10/691,850, filed Oct. 23, 2003 now U.S. Pat. No. 7,051, 782.

FIELD OF THE INVENTION

The present invention relates generally to motorized roller shades. More particularly, the present invention relates to a system for coupling multiple roller shade tubes together for rotation by the same drive system.

BACKGROUND OF THE INVENTION

Motorized roller shade systems include a flexible shade fabric windingly received on a roller tube. The roller tube is supported for rotation about a central axis and is driven by a drive system motor to wind the shade fabric.

Roller shade systems having separate roller tubes secured together for simultaneous rotation are known. The roller tubes are rotatably supported such that the central axes of the tubes are substantially aligned. The tubes of known shade roller systems are fastened together to transfer rotation of one of the tubes, provided by the drive system motor, to the other one of the tubes.

The space occupied by the fastening elements securing roller tubes of known shade systems creates a gap between the ends of the tubes. A corresponding gap, therefore, is also created between the associated shade fabrics wound onto the roller tubes. Reduction in the space occupied by the tube fastening structure in a multiple-tube shade system, therefore, is desirable for limiting potential light gaps between shade fabrics supported by the tubes.

The assembly of the fastening structure for multiple-tube shade systems can be difficult and time-consuming, and may require the use of a specific tool, or tools. Also, the steps involved in fastening the tubes, and in mounting the multiple-tube roller shade to its supporting structure, may render assembly and installation of the roller shade impractical or impossible in applications where only limited clearance is provided.

When position adjustment of one of the shade fabrics of a known multiple-tube shade system is desired, either the tubes must be unfastened to allow for relative rotation between the tubes or the shade fabric must be removed from the associated tube and re-attached. The procedures and time required for unfastening the tubes of a known multiple-tube shade system, therefore, tends to deter a user from adjusting shade position by unfastening the tubes. A multiple-tube shade system having a construction that facilitates uncoupling of the tubes for relative rotation to adjust shade fabric position is desired.

SUMMARY OF THE INVENTION

According to the present invention there is provided an assembly for coupling roller tubes of a roller shade system for simultaneous rotation about a common axis. According to one aspect of the invention, the coupling assembly includes a clutch mechanism received within the interior defined by one of the tube end portions.

The clutch mechanism includes first and second clutch members engageable with each other for torque transfer therebetween. The first clutch member is secured to a drive transfer member contacting an inner surface of the associated tube end portion. The drive transfer member and the first and second clutch members are received by a shaft such that the drive transfer member and the first clutch member are rotatable with respect to the shaft. The first clutch member is restrained against translation with respect to the shaft, which defines an interior.

The clutch mechanism includes a pull rod received within the interior of the shaft for translation therein. The clutch mechanism also includes a draw pin received in aligned draw pin openings of the second clutch member, the shaft and the pull bar. The shaft and the second clutch member each include a pair of oppositely located draw pin openings. The draw pin openings of the shaft are elongated longitudinally with respect to the shaft to provide for translation of the second clutch member with respect to the shaft. The second clutch member is movable between closed and opened clutch positions in which the clutch members are respectively engaged with each other and separated from each other. The pull rod and the shaft further include aligned actuation openings at a location spaced from the draw pin openings. The actuation openings are elongated to provide for insertion of a tool into the pull rod opening to move the second clutch member from the closed clutch position to the opened clutch position.

According to one embodiment, the clutch members comprise halves of a face gear each including teeth spaced about a peripheral portion thereof and adapted for meshing engagement with the teeth of the other face gear half when the second clutch member is in the closed clutch position.

Preferably, the clutch mechanism also includes a biasing spring received by the shaft and located between the second clutch member and a retainer received in a recess formed in the shaft. Preferably, a washer is located between the biasing spring and the retainer. The biasing spring applies a force to the second clutch member tending to maintain the second clutch member in the closed clutch position.

According to another aspect of the invention the coupling assembly includes a support assembly for each pair of adjacently located tube ends. Each of the support assemblies includes a tube-end fitting having inner and outer portions that are rotatable with respect to each other. The outer portion of the tube-end fitting contacts an inner surface of the associated tube end portion. The inner portion is adapted for engagement with support structure for rotatably supporting the associated roller tube.

The support assembly further includes first and second shafts each having a coupler end portion and an opposite tube-engagement end portion. Each shaft is received by one of the tube-end fittings such that the tube-end fitting is located between the coupler end portion and the tube-engagement end portion of the associated shaft. The coupler end portion of the first shaft comprises a curved wall portion substantially defining a partial cylinder. The curved wall portion has side edges forming an access opening to an interior of the curved wall portion. The coupler end portion of the second shaft defines a closed cross-section and is received within the interior of the coupler end portion of the first shaft.

The support assembly also includes a shaft connector received in aligned openings in the coupler end portions of the first and second shafts to releasably secure the first and second shafts to each other. The support assembly further includes first and second drive transfer members secured to the tube-engagement end portions of the respective shafts. Each of the first and second drive transfer members contacts the inner surface of the associated roller tube of the pair of roller tubes for torque transfer therebetween.

According to one embodiment of the invention, the coupling assembly includes first and second mounting plates for each support assemblies arranged in a stacked manner. Preferably, the mounting plates include spaced side portions connected by a top portion. The spaced side portions of the first plate are translatably received in spaced notches provided in the inner portion of the associated tube-end fitting. The second mounting plate also includes a bottom portion between the side portions. The second mounting plate also includes a support panel connected to the bottom portion and oriented substantially perpendicular thereto for supporting the associated tube-end fitting.

Preferably, the coupling assembly also includes a vertical adjustment member for each of the tube-end fittings for vertically adjusting the location of the tube-end fitting. The vertical adjustment member includes a threaded shaft engaging the inner portion of the associated tube-end fitting and a head portion contacting the support panel of the second mounting plate.

According to another embodiment, the first and second mounting plates are secured to bracket by fasteners each received in an opening in the bracket. Preferably, the bracket openings are elongated to provide for horizontal adjustment of the location of the associated tube-end fitting.

DESCRIPTION OF THE INVENTION

Figure 1:
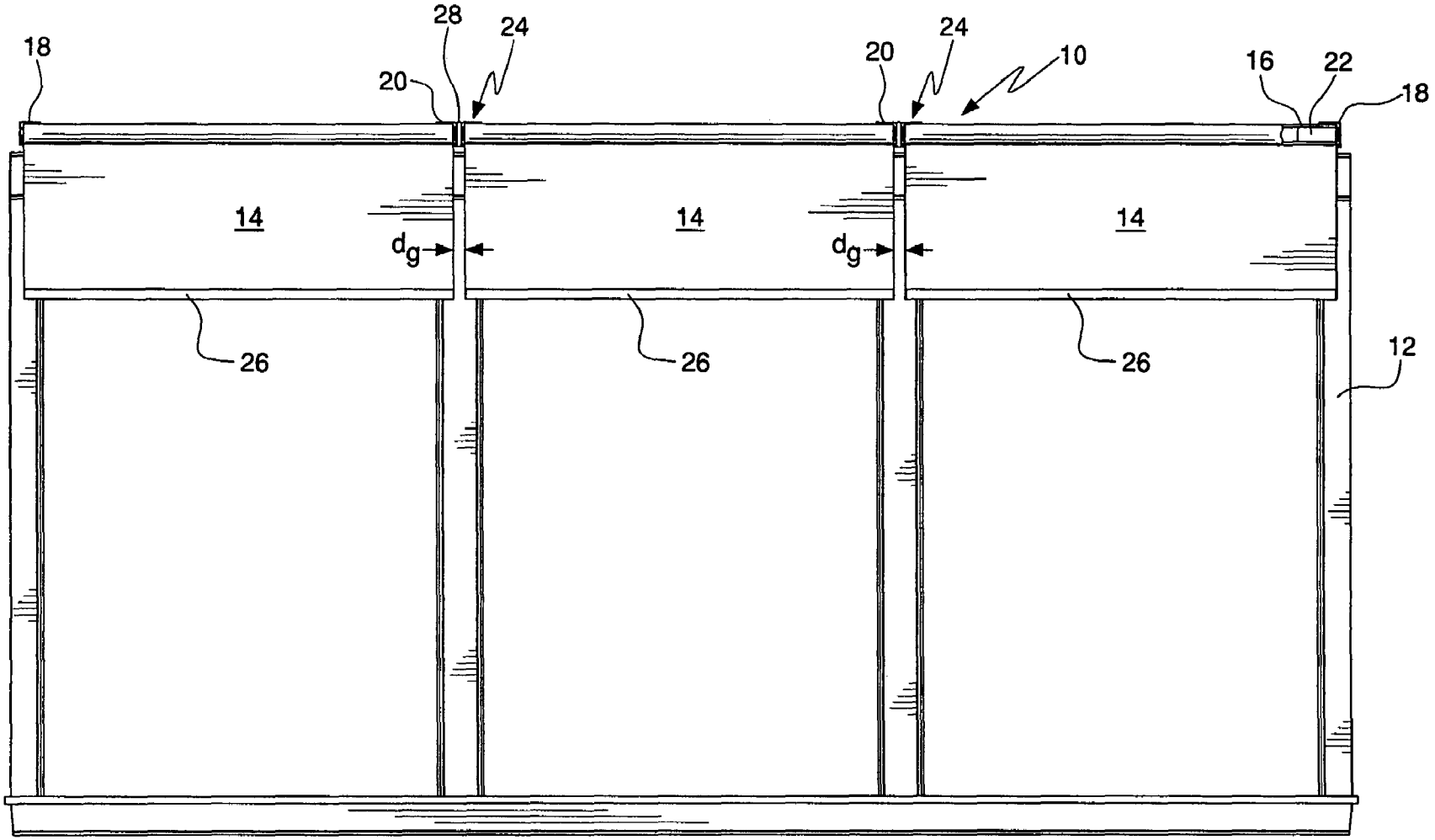
FIG. 1 is a front view of a motorized roller shade according the present invention including multiple roller tubes coupled together for rotation by the same drive system.

Referring to the drawings, where like numerals identify like elements, there is illustrated in FIG. 1 a motorized roller shade system 10 according to the present invention. The roller shade system 10 is mounted to the wall of a structure adjacent a window frame 12. The roller shade system 10 includes three shade fabrics 14 separately wound onto three roller tubes 16. The roller tubes 16 are rotatably supported above the window frame 12 by bracket structure 18 located at the opposite ends of the roller shade system 10 and bracket structure 20 located between the roller tubes 16. The roller shade system 10 includes a motor 22 for rotating the roller tubes 16 to wind and unwind the associated shade fabrics 14. The motor 22 of the drive system is shown schematically in FIG. 1 within an end of one of the roller tubes 16 in a known manner adjacent the right-hand end of the roller shade system 10.

The present invention provides for rotatable support of adjacently located end portions of the roller tubes 16 and interconnection therebetween. The interconnection provided between the roller tubes 16 desirably provides for simultaneous rotation of the multiple roller tubes 16 by the motor 22. As described below in greater detail, the present invention also facilitates optional uncoupling between the adjacently located ends of the roller tubes 16 to provide for relative rotation between the roller tubes. Such relative rotation desirably provides for adjustment of the position of a lower end 26 of one or more of the shade fabrics 14, for example, without requiring that the shade fabric 14 be removed from the associated roller tube 16 or that the roller tube be removed from the roller shade system 10.

Figure 2:
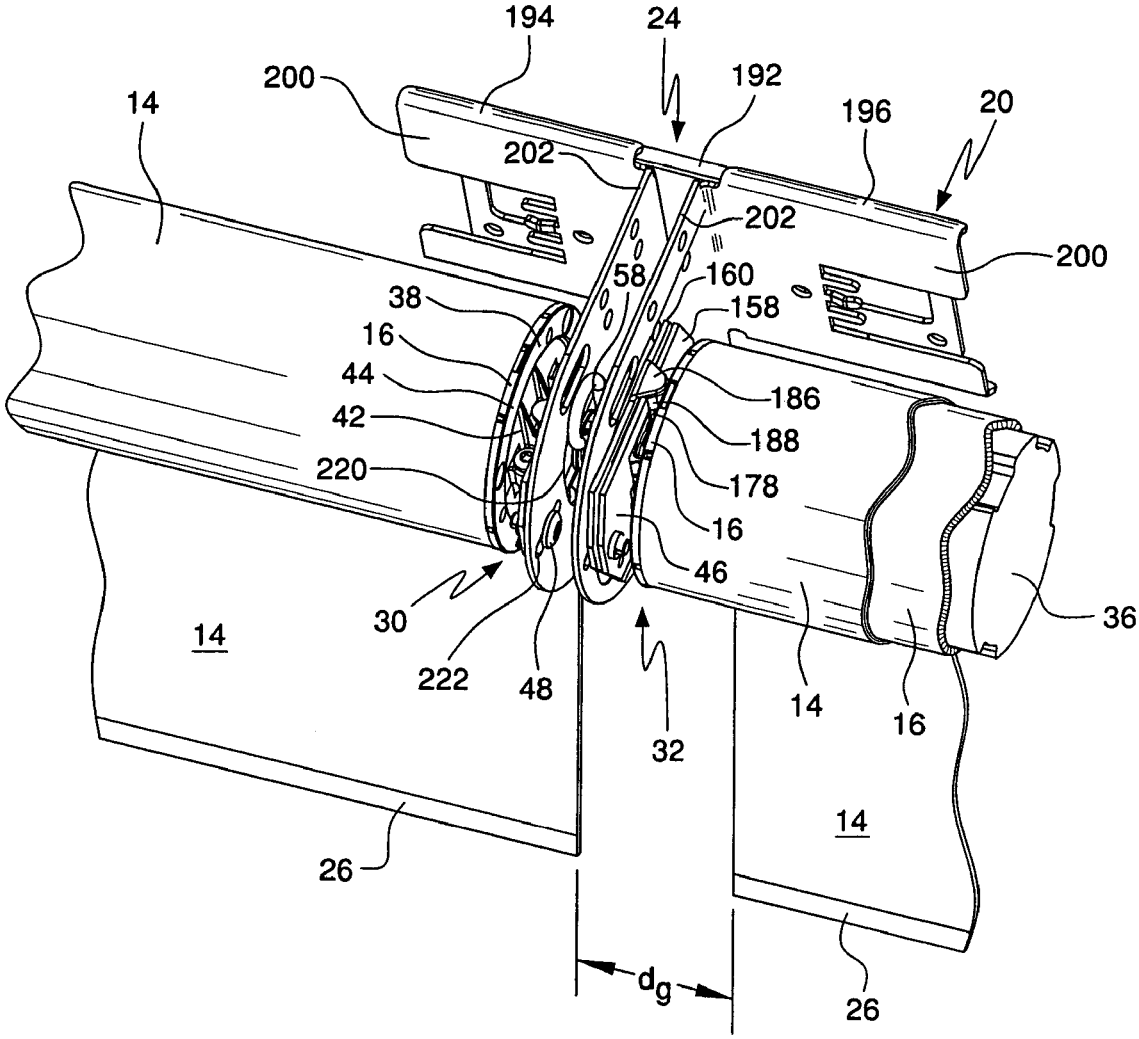
FIG. 2 is a partial perspective view of the roller shade of FIG. 1 showing coupled ends of two roller tubes shown without the removable cover.

Referring to FIGS. 1-4, the coupling system of the present invention includes coupler assemblies 24 located between adjacent ends of the roller tubes 16. As shown in FIGS. 1 and 2, the coupler assembly 24 provides for tube engagement and rotational support with only minimal clearance required between the tubes 16. This construction desirably provides for minimization of the distance, $d_g$, between the side edges of adjacent shade fabrics 14 wound onto the respective roller tubes 16 of the roller shade system 10.

Figure 3:
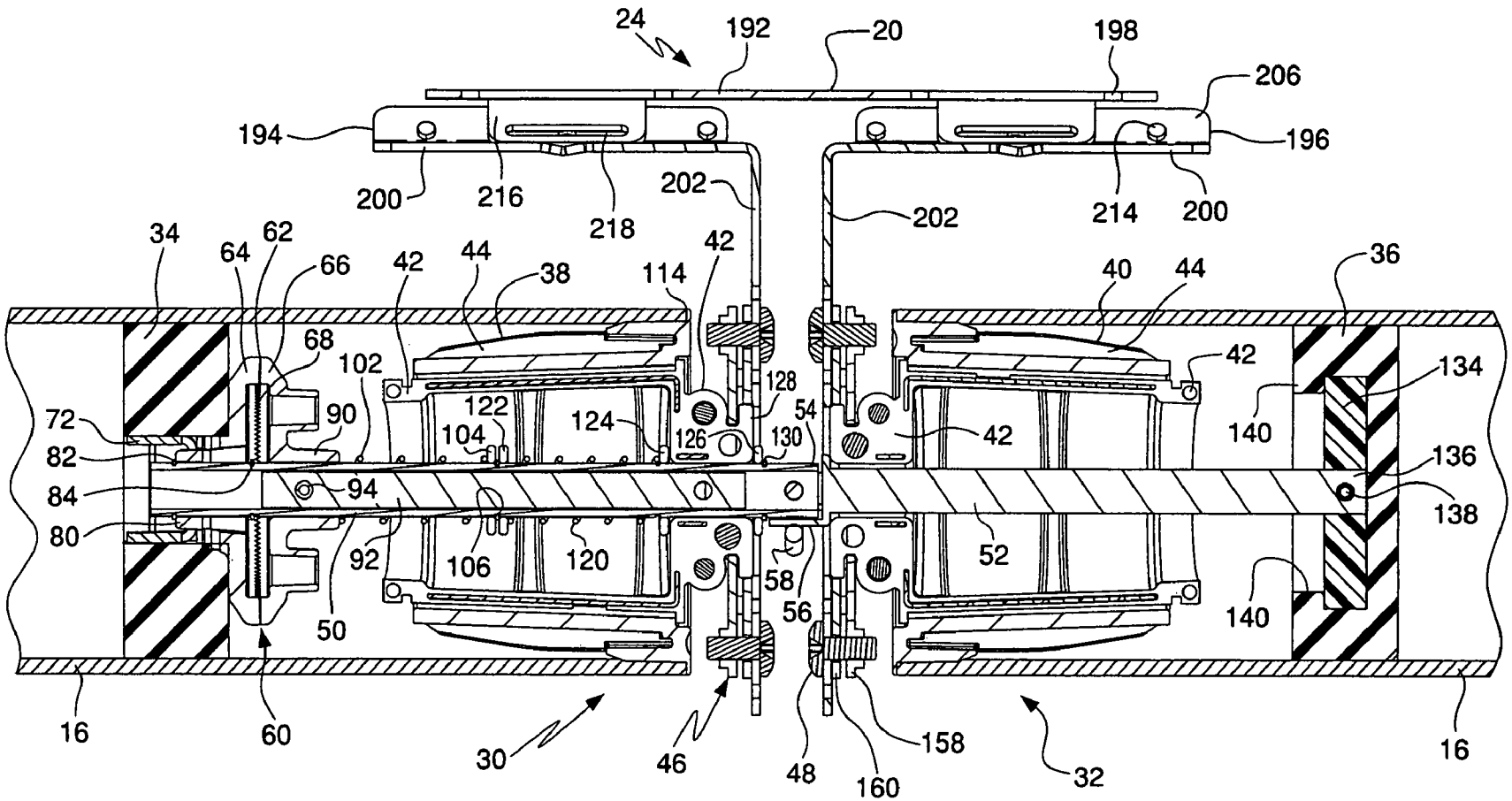
FIG. 3 is a partial section view of the roller shade of FIG. 1 showing the coupler assembly joining two roller tubes.

Referring to FIGS. 2 and 3, there is shown a portion of the roller shade system 10 of FIG. 1 that includes one of the coupler assemblies 24 joining adjacent roller tubes 16. The coupler assembly 24 is shown without the removable cover 28 for clarity of view. The coupler assembly 24 includes first and second sides 30, 32 secured together for torque transfer therebetween. As shown, each of the first and second coupler sides 30, 32 is received by an end of the one of the roller tubes 16 such that a portion is located within an interior defined by the roller tube 16.

The first and second sides 30, 32 of the coupler assembly 24 respectively include drive transfer members 34, 36. Each of the drive transfer members 34, 36 is preferably made from a resilient material such as rubber and is dimensioned for engagement with an inner surface defined by the associated roller tube 16. The engagement between the drive transfer members 34, 36 and the roller tubes 16 provides for torque transfer between the roller tubes 16 and the coupler assembly 24. Rotation of one of the coupled roller tubes 16, by the drive system of roller shade system 10 for example, will be transferred through the coupler assembly 24 resulting in rotation of the other of the coupled roller tubes 16.

The first and second sides 30, 32 of coupler assembly 24 include tube-end fittings 38, 40, respectively. The tube-end fittings 38, 40 connect the roller tubes 16 to the bracket structure 20 and provide for rotatable support of the tubes. Each of the tube-end fittings 38, 40 includes inner and outer portions 42, 44, which are rotatable with respect to each other. The outer portion 44 of each tube-end fitting 38, 40 engages the inner surface of the associated roller tube 16 and defines an annular shoulder that contacts an end of the roller tube 16 to limit receipt of the tube-end fitting 38, 40 within the interior of the tube. As described in greater detail below, the inner portion 42 of each tube-end fitting 38, 40 engages a set 46 of mounting plates, which are in turn secured to the bracket structure 20 by fasteners 48.

The first and second sides 30, 32 of the coupler assembly 24 include shafts 50, 52 respectively, including end portions 54, 56. As shown in FIG. 3, the shafts 50, 52 are received by the tube-end fittings 38, 40 such that the end portions 54, 56 of each of the shafts 50, 52 extends from an end of the associated tube-end fitting 38, 40 opposite the drive transfer members 34, 36, respectively. The end portion 54 of the first side shaft 50 is adapted to receive the end portion 56 of the second side shaft 52 and is secured thereto by a hairpin cotter pin 58 received by both shaft end portions 54, 56. As described in greater detail below, the connection between the shaft end portions 54, 56 provides for torque transfer between the first and second sides 30, 32 of the coupler assembly 24.

Figure 5:
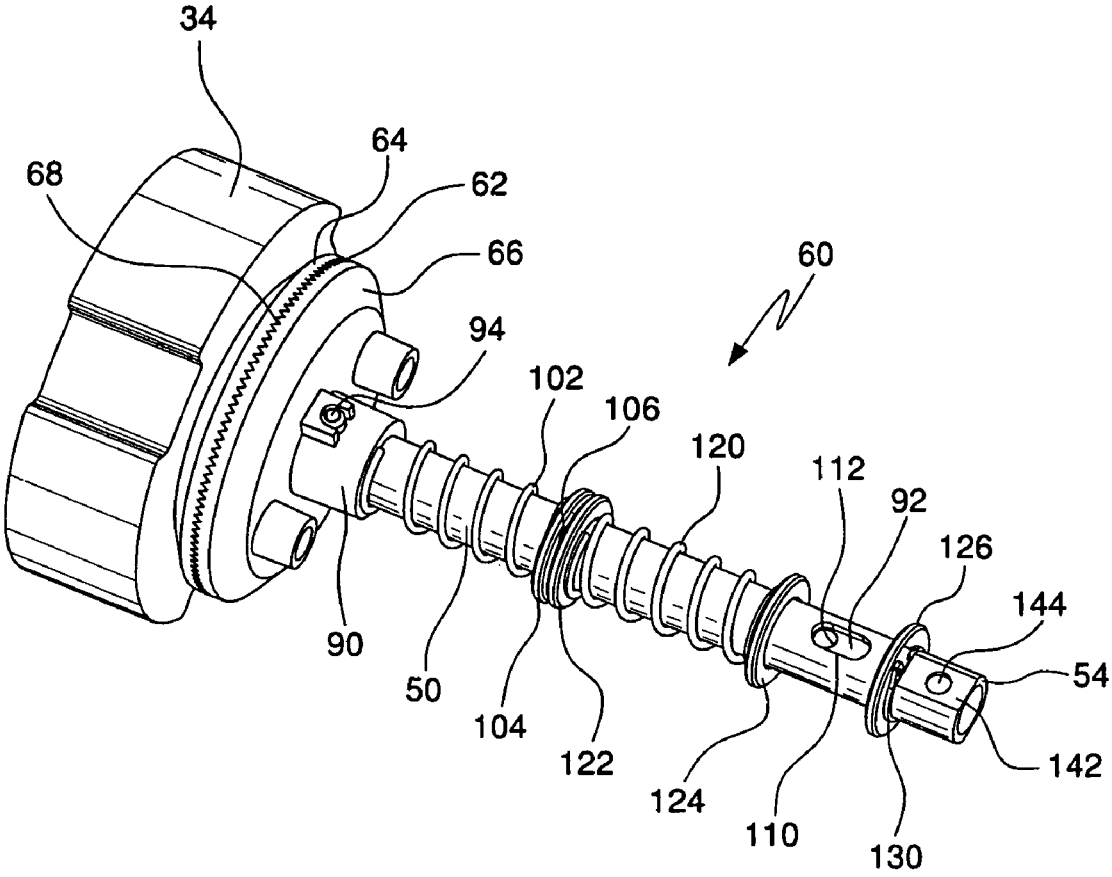
FIG. 5 is a perspective view of the first side of the coupler assembly of FIG. 4 removed from the roller shade system and shown without the tube end rotational fitting and mounting plate set.
Figure 6:
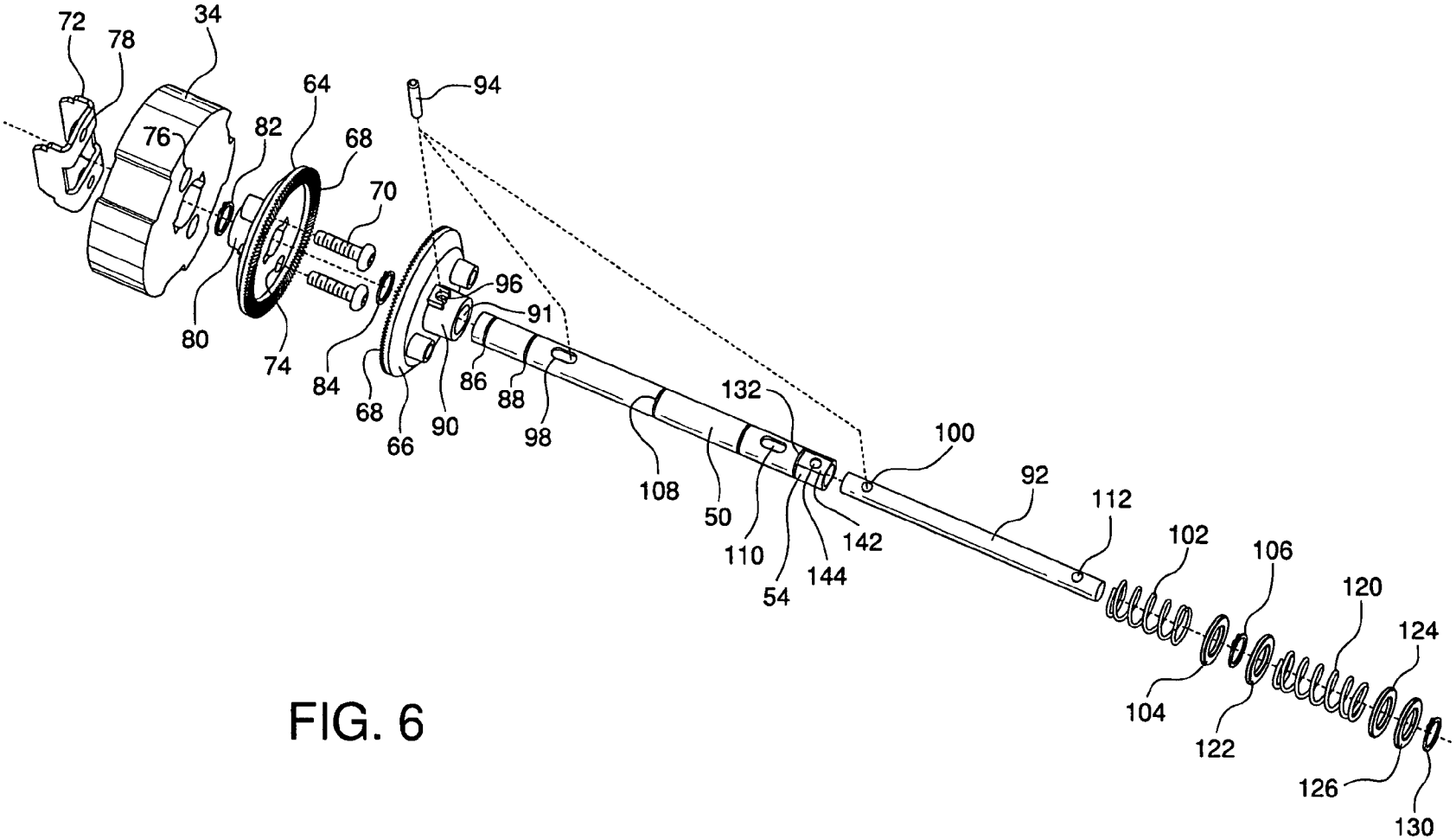
FIG. 6 is an exploded perspective view of the coupler first side of FIG. 5.

As described above, the present invention provides for optional uncoupling of the multiple roller tubes 16 of the roller shade system 10 for relative rotation therebetween. Referring to FIGS. 5 and 6, the coupler assembly 24 includes a clutch mechanism 60, which provides for the optional uncoupling of the multiple roller tubes 16 of roller shade system 10. The first side 30 of the coupler assembly 24 is shown removed from the bracket structure 20 and without the associated tube-end fitting 38 and mounting plate set 46 to facilitate description of the clutch mechanism 60. The clutch mechanism 60 includes a face-gear 62 having first and second halves 64, 66 each defining teeth 68 about a periphery thereof. The teeth 68 of the first and second face-gear halves 64, 66 are dimensioned for engagement and torque transfer therebetween when the face-gear 62 is in the closed condition shown in FIG. 5.

The first half 64 of face-gear 62 is secured to the first side drive transfer member 34 by threaded fasteners 70 and a retainer bracket 72. The fasteners 70 are received through aligned openings 74, 76 of the face-gear first half 64 and drive transfer member 34, respectively, to engage openings 78 in the retainer bracket 72. The face-gear first half 64 includes a substantially cylindrical collar portion 80 defining a bore in which the first side shaft 50 is received. The face-gear first half 64 is restrained against longitudinal movement with respect to the first side shaft 50 by split-ring retainers 82, 84 received in spaced circumferential recesses 86, 88 formed in the outer surface of the first side shaft 50. The face-gear second half 66 also includes a substantially cylindrical collar portion 90 defining a bore 91 that receives the first side shaft 50.

Figure 8:
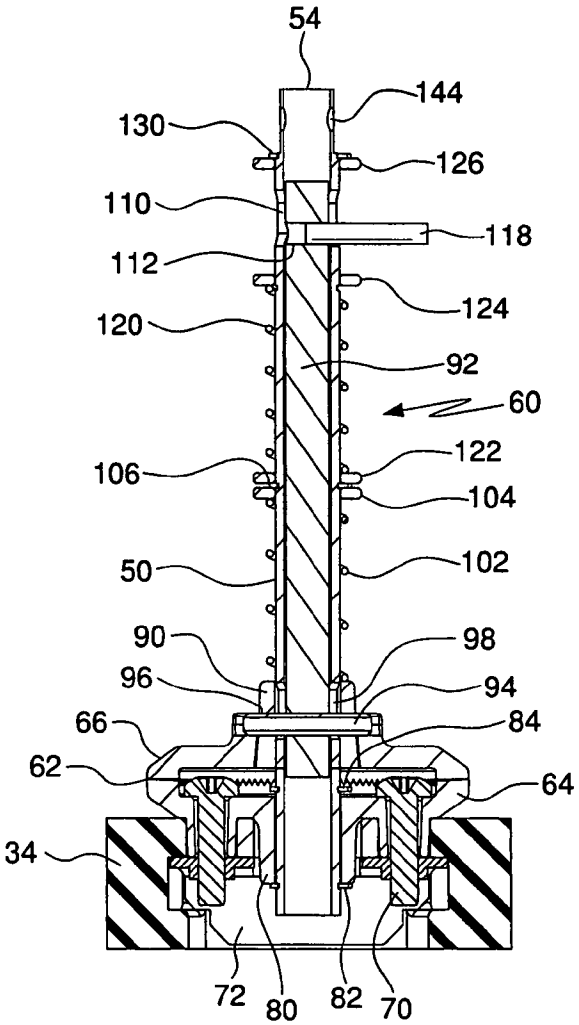
FIG. 8 is a section view of the coupler first side of FIG. 7.
Figure 7:
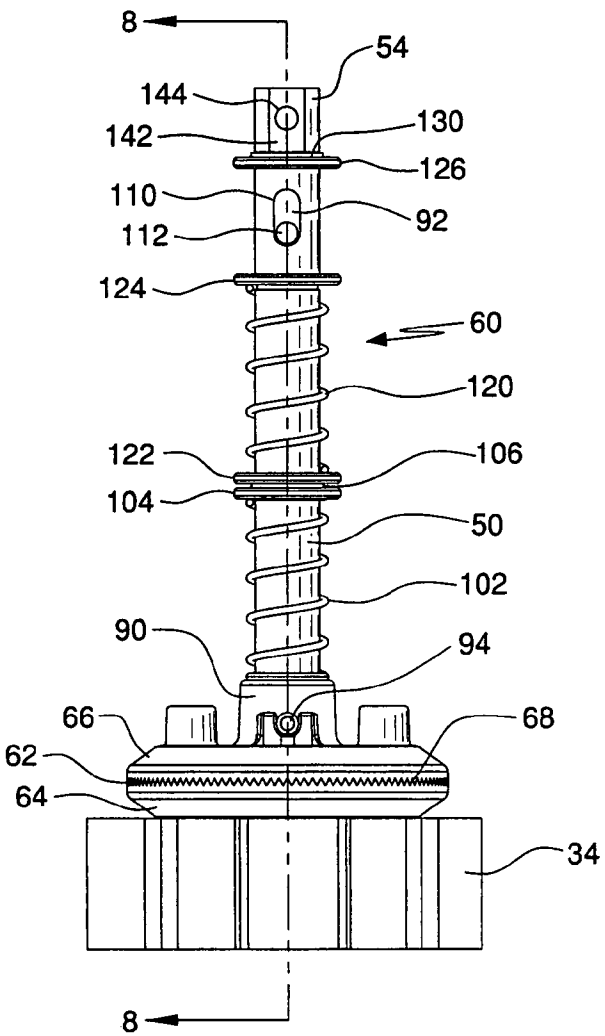
FIG. 7 is a side view of the coupler first side of FIG. 5 showing the clutch mechanism in its closed condition.
Figure 10:
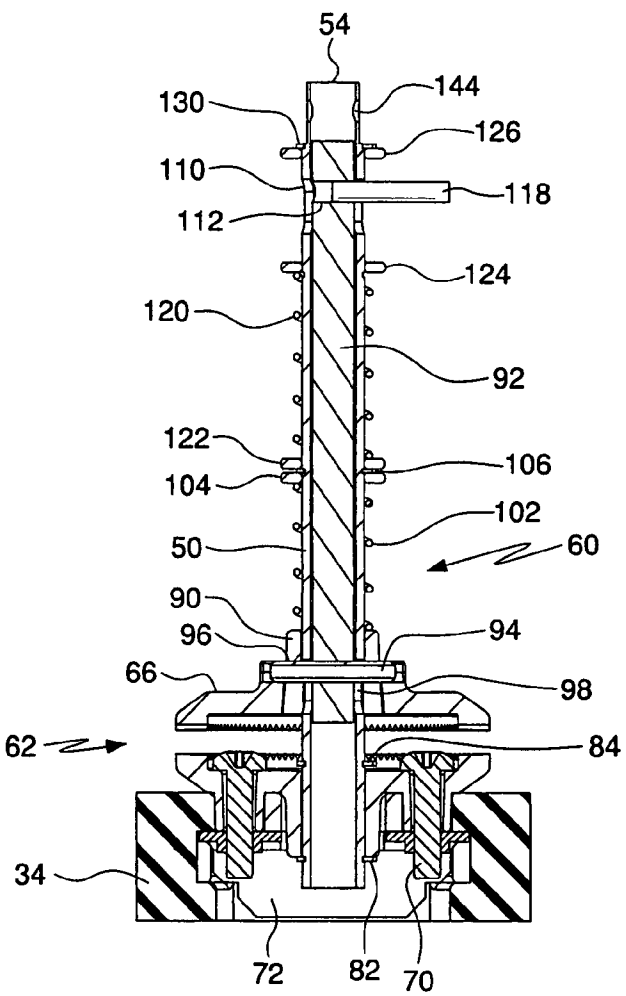
FIG. 10 is a section view of the coupler first side of FIG. 9.
Figure 9:
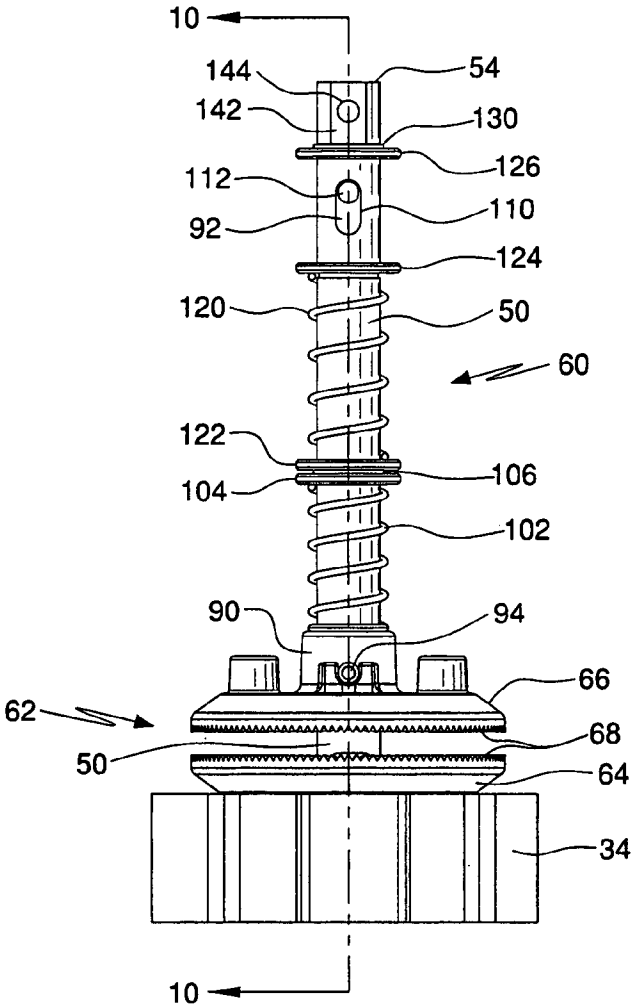
FIG. 9 is a side view of the coupler first side of FIG. 5 showing the clutch mechanism in its opened condition.

Referring to FIGS. 7-10, the clutch mechanism 60 is shown in its closed condition providing torque transfer of the associated roller tubes 16 and its opened condition providing for optional uncoupling of the roller tube 16 and relative rotation therebetween. The clutch mechanism 60 includes a pull rod 92 and a draw pin 94, which provide for longitudinal movement of the face-gear second half 66 with respect to the first side shaft 50. As shown in FIGS. 6 and 8, the draw pin 94 is received in openings 96, 98, 100 respectively provided in the collar portion 90 of the face-gear second half 66, in the first side shaft 50 and in the pull rod 92. Preferably, as shown in FIG. 8, the openings 96, 98 include aligned openings on each of opposite sides of the face-gear second half 66 and the first side shaft 50. The openings 98 in the first side shaft 50 define elongated slots providing for translation of the draw pin 94 with respect to the first side shaft 50 for movement of the face-gear second half 66 between the closed and opened positions for the face gear 62.

The clutch mechanism 60 includes a face-gear biasing spring 102 received on the first side shaft 50. The biasing spring 102 is located between the collar portion 90 of the face-gear second half 66 and a thrust washer 104 translatably received by the first side shaft 50. Longitudinal movement of the thrust washer 104 with respect to the first side shaft 50 is limited by a split-ring retainer 106 received in a longitudinal recess 108 formed in the outer surface of the first side shaft 50. The face-gear biasing spring 102 reacts against the thrust washer 104 and split-ring retainer 106 to apply a biasing force to the face-gear second half 66 tending to maintain the face gear 62 in the closed condition shown in FIGS. 7 and 8.

The first side shaft 50 and the pull rod 92 of clutch mechanism 60 further include openings 110, 112, respectively, located adjacent an end of the first side shaft 50 and the pull rod 92 opposite from the openings 98, 100 discussed above. In a similar fashion to openings 98, the openings 110 of the first side shaft 50 define elongated slots and are preferably located on each of opposite sides of the shaft 50.

Figure 11:
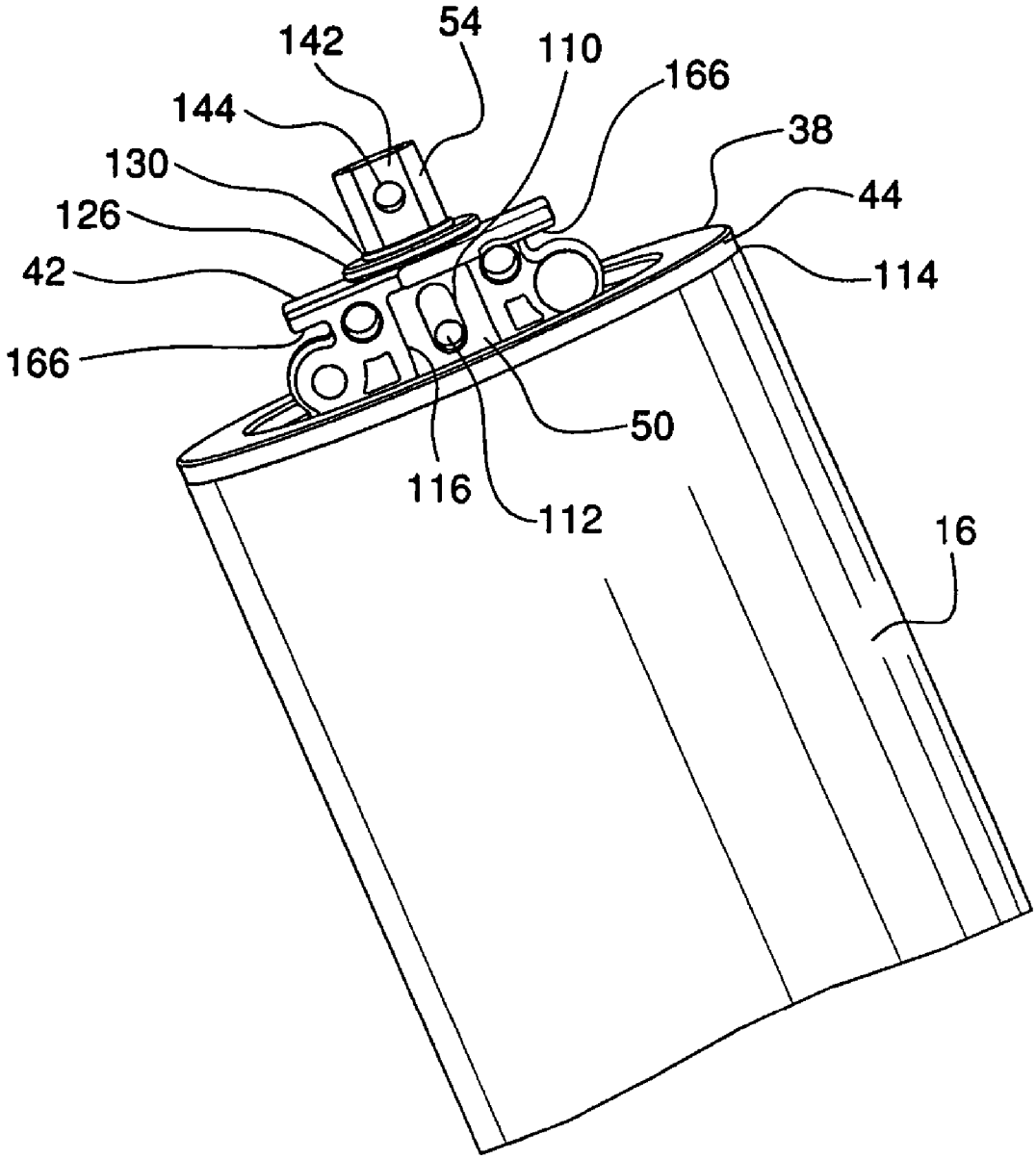
FIG. 11 is a perspective view of the coupler assembly first side and associated roller tube of FIG. 3 shown removed from the roller shade system and without the set of mounting plates.
Figure 13:
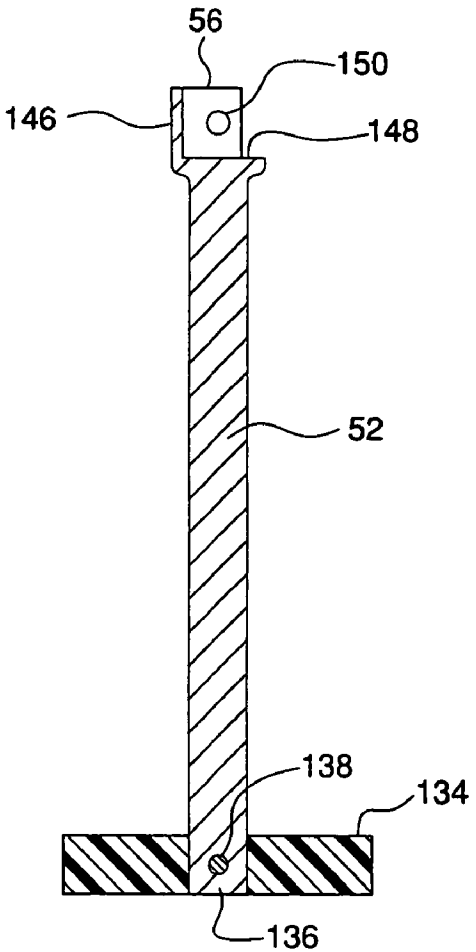
FIG. 13 is a section view of the coupler second side of FIG. 11.

Referring again to FIGS. 3 and 4, the respective openings 110, 112 of the first side shaft 50 and the pull rod 92 are located between an end 114 of the associated roller tube 16 and the set 46 of mounting plates. A space is provided between the roller tube end 114 and the set 46 of mounting plates. As shown in FIG. 11, the inner portion 42 of the first side tube-end fitting 38 provides an access area 116. As shown, the openings 110, 112 in the first side shaft 50 and the pull rod 92 are presented in the access area 116 during rotation of the associated roller tube 16.

The above-described construction desirably provides for relative rotation between the multiple roller tubes 16 in an uncomplicated and rapid manner as follows. The access provided to the openings 110, 112 allows for insertion of an elongated release tool 118, such as a screwdriver for example, into the opening 112 of the pull rod 92 for moving the pull rod 92 and the connected face-gear second half 66. The elongated release tool 118 is shown schematically in FIGS. 8 and 10 inserted into the opening 112 of pull rod 92. Application of force to the pull rod 92 sufficient to overcome the biasing force applied by the face-gear biasing spring 102 causes longitudinal movement of the face-gear second half 66 with respect to shaft 50 to the opened position shown in FIG. 10. This movement separates the face-gear halves 64, 66, and the associated teeth 68, from each other allowing for relative rotation between the face gear halves 64, 66 and, therefore, between the pair of roller tubes 16 otherwise coupled together by the coupler assembly 24.

The coupler assembly first side 30 also includes a locator spring 120 received on the first side shaft 50 between a pair of thrust washers 122, 124. As shown in FIG. 3, the thrust washer 122 contacts the split-ring retainer 106 opposite the thrust washer 104 provided for face-gear biasing spring 102.

Thrust washer 124 contacts the inner portion 42 of the first side tube-end fitting 38. Another thrust washer 126 is received on the first side shaft 50 and is located outside of the first side tube-end fitting 38 to contact an end surface 128 of the associated inner portion 42. A split-ring retainer 130 is received in a circumferential recess 132 in the first side shaft 50 adjacent the shaft end portion 54. The thrust washer 126 and split-ring retainer 130 limit removal of the first side tube-end fitting 38 from the first side shaft 50. The locator spring 120 reacts against the thrust washer 122 and the inner portion 42 of the first side tube-end fitting 38 to bias the first side shaft 50 with respect to the tube-end fitting 38. As an alternative to locator spring 120, the coupler assembly first side 30 could include a thrust washer, contacting an end of the tube-end fitting 38 opposite the thrust washer 126, and a split-ring retainer received in a recess in first side shaft 50 to limit translation of tube-end fitting 38.

Figure 4:
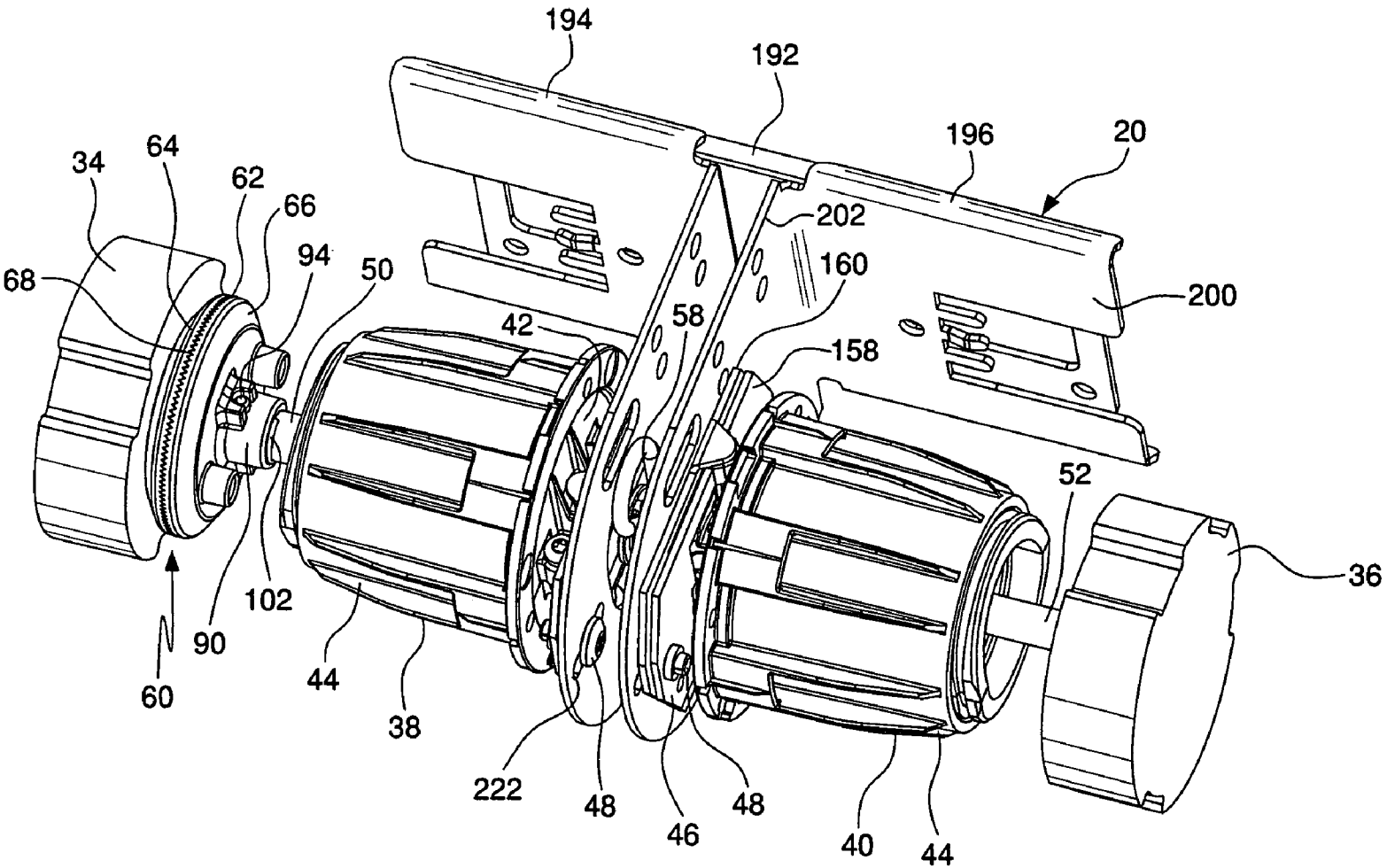
FIG. 4 is a perspective view of the coupler assembly of FIG. 3.
Figure 12:
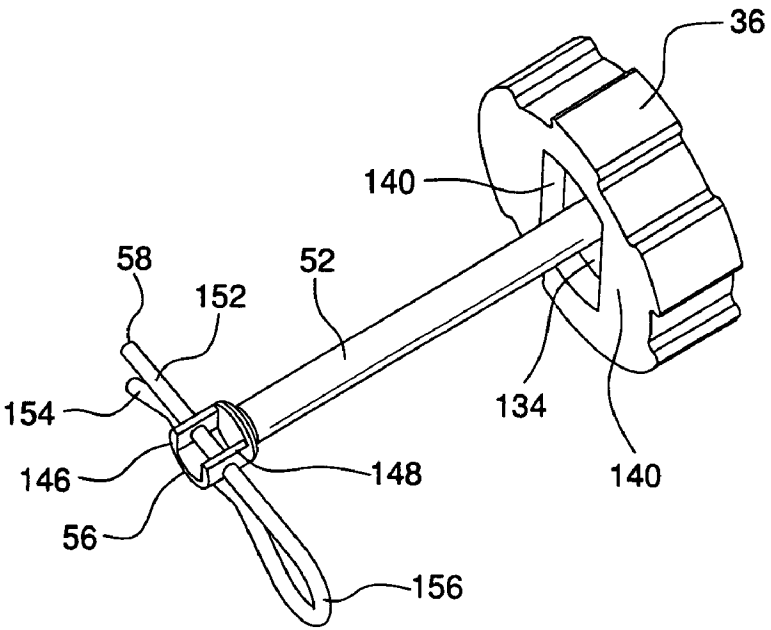
FIG. 12 is a perspective view of the second side of the coupler assembly of FIG. 4 removed from the bracket structure and shown without the tube end rotational fitting.

Referring to FIG. 12, the second side 32 of the coupler assembly 24 is shown removed from the coupler assembly 24 and without the second side tube-end fitting 40 and mounting plate set 46. In FIG. 12, the hairpin cotter pin 58 is shown engaged with the end portion 56 of the second side shaft 52. As described below in greater detail, however, to secure the first and second shafts 50, 52 together as shown in FIGS. 3 and 4, the hairpin cotter pin 58 is received by both end portions 54, 56 of the first and second side shafts 50, 52. The coupler assembly second side 32 includes a drive transfer mount 134, which receives an end 136 of the second side shaft 52 and is secured to the shaft by a pin 138. As shown in FIGS. 3 and 12, the drive transfer mount 134 is received within an interior defined by the second drive transfer member 36 and is retained therein by opposite peripheral ledges 140 defined by the drive transfer member 36. As described above, the drive transfer member 36 is preferably made from a resilient rubber material. Preferably, the drive transfer mount 134 is made from a relatively rigid plastic material. The resilient nature of the drive transfer member 36 facilitates insertion of the relatively rigid drive transfer mount 134 within the interior defined by the drive transfer member 36.

Figure 14:
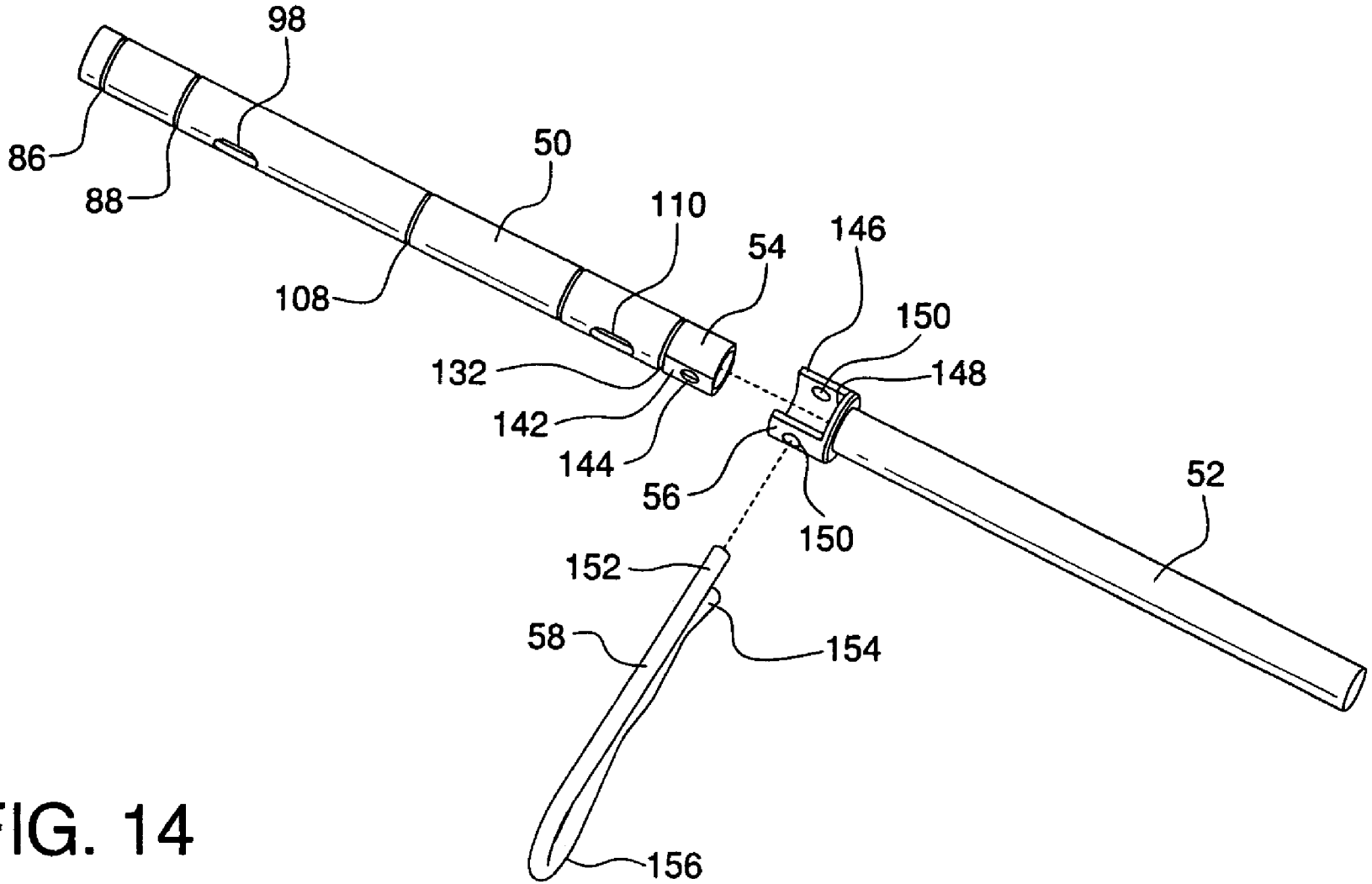
FIG. 14 is an exploded perspective view showing the shafts of the coupler first and second sides and the shaft connector of the coupler assembly of FIG. 3.

Referring to FIG. 14, the first shaft end portion 54 includes opposite faceted sides 142 each including an opening 144. The second shaft end portion 56 includes a curved wall 146 in the form of a partial cylinder such that an access opening 148 is defined by the shaft end portion 56. Aligned openings 150 are formed in the curved wall 146 of second shaft end portion 56. As illustrated by the dashed lines, the first shaft end portion 54 is received by the second shaft end portion 56 such that the openings 144, 150 are aligned with each other. The hairpin cotter pin 58, which is preferably a cotter pin, is received through the aligned openings 144, 150 to secure the shafts 50, 52 to each other.

The use of a hairpin cotter pin to connect the shaft end portions 54, 56 is not required. It is conceivable that shaft connectors of various construction could be received through the aligned openings 144, 150 formed in the shaft end portions 54, 56 to secure them together. The use of the hairpin cotter pin 58, however, which includes two leg portions 152, 154 and a curved return portion 156 provides a useful visual aid for orienting the shafts 50, 52 for insertion of the elongated release tool 118 for opening the clutch mechanism 60. As described above, the first side shaft 50 includes two slotted openings 110 located oppositely from each other on the first side shaft 50. Therefore, the pull rod opening 112 will be presented in the access area 116 shown in FIG. 11 with every 180 degrees of rotation of the associated roller tube 16. Referring to FIG. 4, the elongated, and non-symmetric, shape of the hairpin cotter pin 58 facilitates rapid determination of the angular position of the shafts 50, 52 without requiring proximity to the coupler assembly 24 for a close examination of the access area 116.

The shafts 50, 52 of the first and second sides 30, 32 are shown in FIG. 14 separated from each other in a longitudinal direction with respect to the shafts. It should be understood, however, that the above described construction, which includes faceted sides 142 for shaft end portion 54 and an access opening 148 in shaft end portion 56, also provides for insertion of shaft end portion 54 in a transverse direction with respect to the shafts 50, 52. Such optional transverse receipt of shaft end portion 54 by shaft end portion 56 desirably provides for assembly and disassembly of the coupler assembly 24 in limited clearance installations where an in-line assembly in a longitudinal direction is either impractical or impossible.

Figure 15:
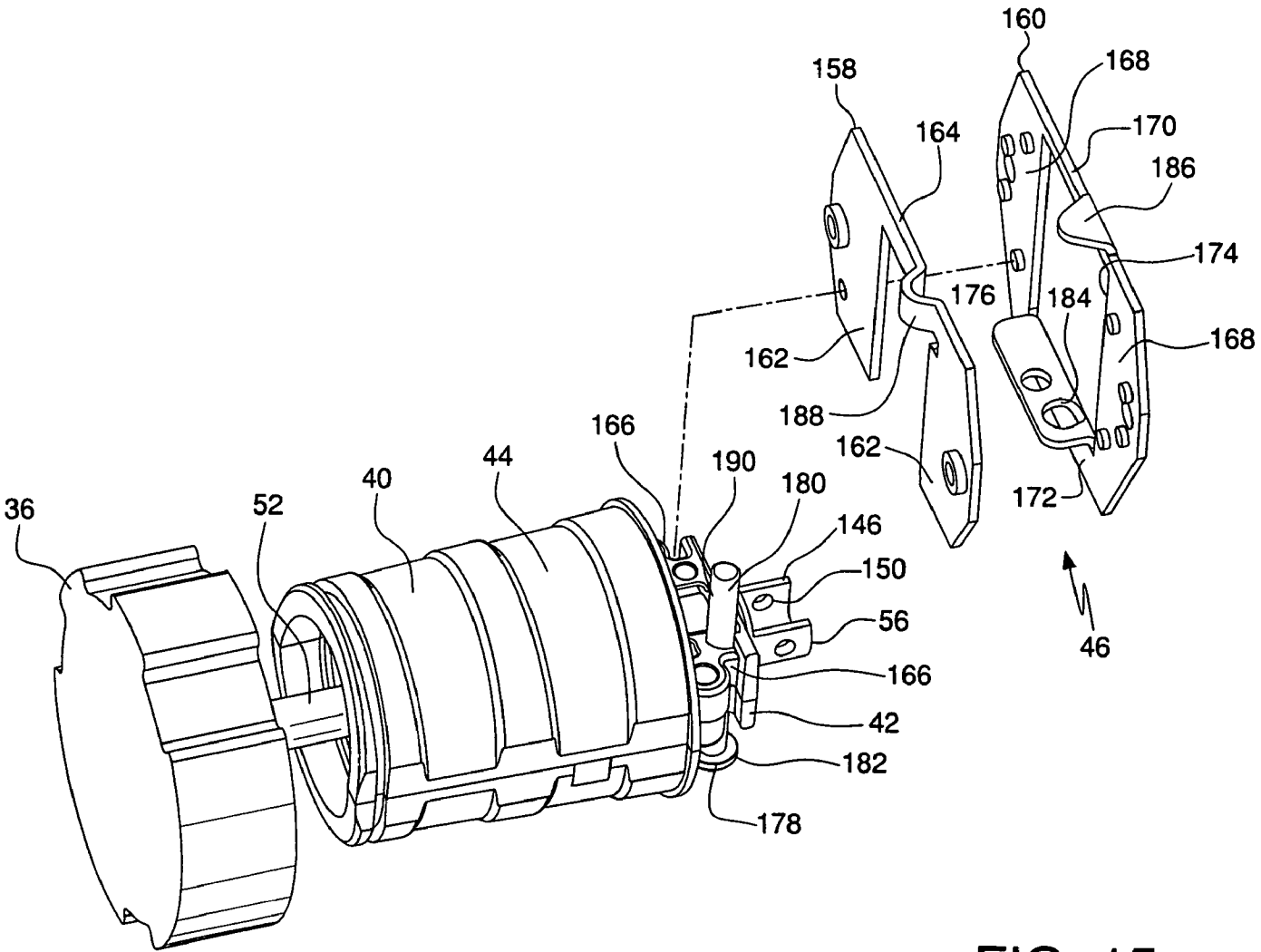
FIG. 15 is a perspective view of the second side of the coupler assembly of FIG. 4 removed from the bracket structure and showing the set of mounting plates separated from the tube-end fitting.

Referring to FIG. 15, the second side 32 of the coupler assembly 24 is shown removed from the coupler assembly and with the set 46 of mounting plates separated from the tube-end fitting 40. The set 46 of mounting plates includes first and second plates 158, 160. A similar set 46 of mounting plates is provided for the first side 30 of the coupler assembly 24. The first plate 158 includes spaced side portions 162 interconnected by a top portion 164. The spacing of the side portions 162 provides for receipt of the first plate 158 in opposite notches 166 defined by the inner portion 42 of the associated tube-end fitting 38, 40. The second plate 160 includes spaced side portions 168 and top and bottom portions 170, 172 interconnecting the side portions 168 to define a rectangular opening 174. The rectangular opening 174 receives the inner portion 42 of the associated tube-end fitting 38, 40 and shaft 50, 52. As shown in FIGS. 3 and 4, the first and second plates 158, 160 of each mounting plate set 46 are adapted for placement in a stacked relationship and are secured to the bracket structure 20 by the above-identified fasteners 48.

Referring again to FIG. 15, the second plate 160 of each mounting plate set 46 includes a support panel 176 connected to the bottom portion 172 and oriented substantially perpendicular thereto. A vertical adjustment member 178 includes an elongated shaft portion 180 threadedly engaging the inner portion 42 of the associated tube-end fitting 38, 40. An enlarged head portion 182 of the vertical adjustment member 178 rests on the support panel 176 of the second plate 160. The head portion 182 contacts an opening 184 provided in the support panel 176 in a nesting manner. A tab projection 186 connected to the second plate top portion 170 is located adjacent a curved part 188 of the first plate top portion 164. A terminal end portion 190 of the vertical adjustment member 178 opposite the head portion 182 is located between the curved part 188 of the first plate top portion 164 and the second plate top portion 170. The location of the vertical adjustment member 178 with respect to the associated tube-end fitting 38, 40 is varied by rotating the vertical adjustment member 178. This results in adjustment of the location of the tube-end fitting 38, 40 with respect to the mounting plate set 46 and the bracket structure 20 to which the mounting plate set 46 is secured.

Figure 16:
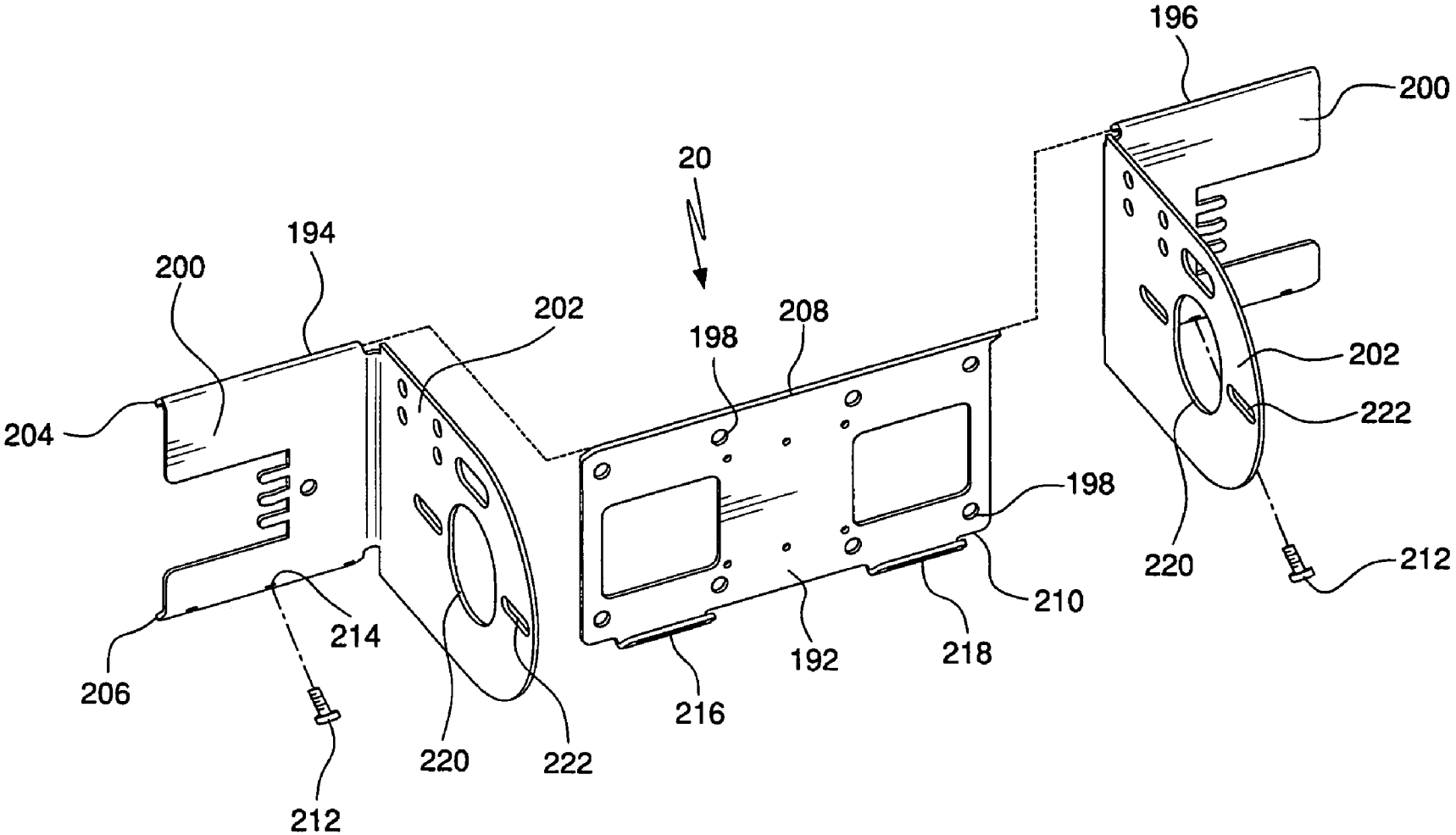
FIG. 16 is an exploded perspective view of the bracket structure of the coupler assembly of FIG. 4.

Referring to FIG. 16, the bracket structure 20 of the coupler assembly 24 is shown in greater detail. The bracket structure 20 includes a base member 192 and first and second angle brackets 194, 196. The base member 192 includes openings 198 for attachment of the base member 192 to the wall of a structure, for example, using screws (not shown). Each of the angle brackets 194, 196 includes a base-connecting panel 200 and a tube-support panel 202, which are oriented substantially perpendicular to each other. The base-connecting panel 200 includes opposite side edges 204, 206. Side edge 204 forms a returned portion of the base-connecting panel 200 received by an edge 208 of the base member 192 in hook-like fashion for hanging support of the angle brackets 194, 196 on the base member 192. Side edge 206 of the base-connecting panel 200 is rounded for receipt of the side edge on tab projections 216 of the base member 192, as shown in FIG. 3.

The engagement between the base-connecting panel side edges 204, 206 and the base member 192 provides for sliding of the angle brackets 194, 196 with respect to the base member 192. Screws 212 received in openings 214 of the base-connecting panel adjacent the side edge 206 engage slotted openings 218 formed in the tab projections 216 of the base member 192. The engagement provided by screws 212 limits the relative movement between the angle brackets 194, 196 and the base member 192.

The tube support panel 202 of each angle bracket 194, 196 includes an opening 220 for receipt of the associated shaft 50, 52 of the first and second tube coupler sides 30, 32. Slot openings 222 located on opposite sides of the shaft opening 220 are engaged by the fasteners 48 to secure the mounting plate sets 46 to the bracket structure 20. The inclusion of the slot openings 222 allows for horizontal adjustment of the location of the plate sets 46 with respect to the bracket structure 20 and, therefore, horizontal adjustment of the shafts 50, 52.

In FIGS. 2-4, the clutch mechanism 60 is shown within the roller tube 16 that is located on the left-hand side of the coupler assembly 24. As described above, the motor 22 is shown in FIG. 1 located adjacent the right-hand side of the roller shade system 10. Arranged in this manner, the roller tube 16 on the right-hand side of FIGS. 2-4 will be located on the motor-side of the associated coupler assembly 24. When a user actuates the clutch mechanism 60 in the above-described manner, the left-hand side roller tube 16 opposite the motor-side of the assembly will be released for manual rotation while the motor-side roller tube 16 is held against rotation.

The number of teeth 68 provided for the first and second halves 64, 66 of face-gear 62 may vary from that shown in the drawings. The use of a relatively large number of teeth in the manner shown, however, desirably facilitates re-engagement between the teeth 68 of the respective face-gear halves 64, 66 when the second face-gear half 66 is returned by the biasing spring 102. The relatively fine-toothed construction shown in the drawings provides for meshing engagement of the teeth 68 of the first and second face-gear halves 64, 66 in rotational increments of 3 degrees.

The force applied to the face-gear 62 by the biasing spring 102 tends to maintain the face-gear 62 in the closed condition. This desirably serves to ensure meshing engagement between the teeth for torque transfer through the coupler assembly 24 when simultaneous driving of multiple shades by a single drive system is desired. The roller shade system may include more or fewer roller tubes than the three that are shown in the drawings. The number of roller tubes that may be coupled together in a given application will be limited by the torque capability of the drive system associated with the roller shade.

The foregoing describes the invention in terms of embodiments foreseen by the inventor for which an enabling description was available, notwithstanding that insubstantial modifications of the invention, not presently foreseen, may nonetheless represent equivalents thereto.

What is claimed is:

1. A shade system comprising:

a plurality of elongated roller tubes each having opposite end portions, the roller tubes substantially aligned along a common axis of rotation and arranged to define at least one pair of adjacently located tube end portions, each of the roller tubes adapted for winding receipt of a flexible shade fabric, each of the flexible shade fabrics defining a bottom edge; and a clutch mechanism for each pair of adjacently located tube end portions, the clutch mechanism including first and second clutch members, the first clutch member operably engaging a first one of the tube end portions and the second clutch member operably engaging the adjacently located tube end portion for torque transfer therebetween;

the clutch members supported for relative movement with respect to each other between a closed clutch position in which the first and second clutch members engage each other for torque transfer therebetween and an opened clutch position in which the clutch members are disengaged from each other, the closed clutch position providing for simultaneous rotation of the associated tube end portions, the opened clutch position providing for relative rotation between the associated tube end portions, thereby providing for relative adjustment of the bottom edges of the associated flexible shade fabrics.

2. The shade system according to claim 1, wherein each one of the first and second clutch members includes a plurality of teeth adapted for meshing engagement with the teeth of the other one of the first and second clutch members when the first and second clutch members are in the closed clutch position.

3. The shade system according to claim 1, wherein the first and second clutch members are received by a shaft, the first clutch member rotatably supported by the shaft and secured against translation thereto, the second clutch member translatable with respect to the shaft between the opened and closed clutch positions.

4. The shade system according to claim 3, wherein the first and second clutch members comprise first and second halves of a face gear, each half of the face gear defining an opening receiving the shaft, and wherein each half of the face gear defines a plurality of teeth spaced circumferentially about a central axis, the teeth of each one of the face gear halves adapted for meshing engagement with the teeth of the other one of the face gear halves when the first and second clutch members are in the closed clutch position.

5. The shade system according to claim 1, wherein the clutch mechanism includes a biasing member contacting one of the clutch members to apply a biasing force to the clutch member tending to maintain the clutch members in the closed clutch position.

6. The shade system according to claim 3, wherein the clutch mechanism further includes an elongated pull rod engaging the second clutch member from a location that is remote from the second clutch member to provide for movement of the second clutch member.

7. The shade system according to claim 6, wherein the shaft defines an interior and the pull rod is received within the shaft interior for translation therein, and wherein the second clutch member is secured to the pull rod by a draw pin received in aligned openings in the second clutch member and the pull rod, the draw pin extending through an elongated opening in the shaft to provided for translation of the second clutch member and the pull bar with respect to the shaft.

8. The shade system according to claim 7, wherein the shaft includes at least one access opening located at a distance from the elongated draw pin opening, the access opening aligned with an opening in the pull rod for receipt of a release tool for movement of the second clutch member.

9. The shade system according to claim 8, wherein the access opening of the shaft is located at an exterior location with respect to the interior defined by the first one of the associated pair of tube end portions.

10. The shade system according to claim 3, wherein the shaft of the clutch mechanism is oriented substantially parallel to the common axis of rotation.

11. A motorized shade system comprising:

a plurality of elongated roller tubes each having opposite end portions, the roller tubes substantially aligned along a common axis of rotation and arranged to define at least one pair of adjacently located tube end portions, each of the roller tubes adapted for winding receipt of a flexible shade fabric, each of the flexible shade fabrics defining a bottom edge;

a pair of support assemblies for each pair of tube end portions, each support assembly of the pair of support assemblies engaging one of the tube end portions of the associated pair of tube end portions and adapted to rotatably support the tube end portion, the support assemblies of the pair of support assemblies secured together to provide for simultaneous rotation of the roller tubes associated with the pair of tube end portions; and a clutch mechanism for each pair of tube end portions, the clutch mechanism received within an interior defined by a first one of the associated tube end portions, the clutch mechanism adapted for actuation to release the roller tube associated with the first one of the associated tube end portions for relative rotation with respect to the roller tube associated with the other one of the associated tube end portions, thereby providing for relative adjustment of the bottom edges of the associated flexible shade fabrics.

12. The shade system according to claim 11, wherein each of the support assemblies includes a tube-end fitting having inner and outer portions rotatable with respect to each other, the outer portion contacting an inner surface defined by the associated tube end portion, the inner portion secured to a bracket structure of the shade system.

13. The shade system according to claim 12, further comprising first and second mounting plates for each of the tube-end fittings, each of the first and second mounting plates including spaced side portions connected by a top portion, the spaced side portions of the first mounting plate translatably received by opposite notches provided in the inner portion of the associated tube-end fitting, the second mounting plate further including a bottom portion between the spaced side portions and a support panel connected to the bottom portion and oriented substantially perpendicular thereto, the support panel supporting the inner portion of the associated tube-end fitting.

14. The shade system according to claim 13, further including a vertical adjustment member for each of the tube-end portions, the vertical adjustment member including a threaded shaft portion engaging the inner portion of the associated tube-end fitting and a head portion contacting the support panel of the associated second mounting plate.

15. The shade system according to claim 13, wherein the bracket structure includes a pair of brackets each attached to the first and second mounting plates associated with one of the tube-end fittings, each bracket including at least one opening receiving a fastener, the fastener received in aligned openings in the associated first and second mounting plates, the bracket openings being elongated to provide for horizontal adjustment of the location of the associated tube-end fitting with respect to the bracket structure.

16. The shade system according to claim 11, wherein the clutch mechanism includes a first clutch member operably engaging an inner surface defined by the first one of the associated tube end portions and a second clutch member, the first and second clutch members adapted for engagement with each other in a closed clutch position, the second clutch member supported for translation with respect to the first clutch member between the closed clutch position and an opened clutch position in which the second clutch member is disengaged from the first clutch member.

17. The shade system according to claim 16, wherein the clutch mechanism includes a shaft receiving the first and second clutch members such that the first clutch member is rotatably supported by the shaft, the first clutch member restrained against translation with respect to the shaft, the shaft defining an interior, the clutch mechanism further including a pull rod translatably received within the interior of the shaft, the clutch mechanism further including a draw pin received in aligned draw pin openings provided in the second clutch member, the shaft and the pull rod, the draw pin openings of the shaft including a pair of oppositely located draw pin openings, the draw pin openings of the shaft being elongated longitudinally with respect to the shaft to provide for remote actuation of the clutch mechanism to move the second clutch member between the closed and opened positions.

18. The shade system according to claim 11, further comprising:

a drive system including a motor operably engaged with one of the roller tubes for rotating the roller tube about the common axis of rotation.

19. A method for adjusting a second shade fabric relative to a first adjacent shade fabric, the first and second shade fabrics having bottom edges, the first and second shade fabrics connected to first and second roller tubes, respectively, for winding receipt of the shade fabrics, the roller tubes aligned along a common axis of rotation, the method comprising the steps of:

coupling the second roller tube to the first roller tube via a coupling mechanism such that when the coupling mechanism is in a closed position, the bottom edge of the second shade fabric is fixed in relation to the bottom edge of the first shade fabric and the roller tubes are operable to simultaneously rotate;

disengaging the coupling mechanism to place the coupling mechanism in an open position to allow for free rotation of the second roller tube;

rotating the second roller tube to adjust the position of the bottom edge of the second shade fabric relative to the bottom edge of the first shade fabric; and engaging the coupling mechanism to fix the bottom edge of the second shade fabric in relation to the bottom edge of the first shade fabric.

20. The method according to claim 19, further comprising the steps of:

supporting the clutch mechanism by a shaft;

attaching a first half of the clutch mechanism to the shaft such that the first half of the clutch mechanism is rotatably supported by the shaft and secured against translation with respect thereto; and translating a second half of the clutch mechanism with respect to the shaft between the open and closed clutch positions.

21. The method according to claim 20, wherein the step of coupling further comprises biasing the second half of the clutch mechanism towards the first half of the clutch mechanism with a biasing force to maintain the halves of the clutch mechanism in the closed position.

22. The method according to claim 21, wherein the step of disengaging further comprises translating the second half of the clutch mechanism away from the first half of the clutch mechanism along an axis substantially parallel to the common axis of rotation.

23. The method according to claim 22, further comprising the step of:

engaging the second half of the clutch mechanism with an elongated pull rod;

wherein the step of disengaging further comprises biasing the pull rod to translate the second half away from the first half of the clutch mechanism.

24. The method according to claim 23, further comprising the step of:

providing a tool-receiving opening in the pull rod;

wherein the step of disengaging further comprises biasing the pull rod with a release tool received within the tool-receiving opening.

25. The method according to claim 21, wherein the step of engaging comprises biasing the second half toward the first half of the clutch mechanism with the biasing force to maintain the clutch mechanism in the closed position.

26. The method according to claim 21, further comprising the steps of:

providing each one of the first and second halves of the clutch mechanism with a plurality of teeth; and fixing the teeth of the first half in meshing engagement with the teeth of the second half when the clutch mechanism is in the closed clutch position.

27. The method according to claim 19, further comprising the step of:

driving one of the roller tubes with a motor for rotating the roller tubes about the common axis of rotation.

28. The shade system according to claim 1, further comprising:

a drive system including a motor operably engaged with one of the roller tubes for rotating the roller tubes about the common axis of rotation.

* * * * *